US008801534B1

(12) United States Patent
Rydberg

(10) Patent No.: US 8,801,534 B1
(45) Date of Patent: Aug. 12, 2014

(54) RETRIEVER

(71) Applicant: Randy Rydberg, Alta, IA (US)

(72) Inventor: Randy Rydberg, Alta, IA (US)

(73) Assignee: Graball Golf Products, Inc., Alta, IA (US)

( * ) Notice: Subject to any disclaimer, the term of this patent is extended or adjusted under 35 U.S.C. 154(b) by 0 days.

(21) Appl. No.: 14/022,668

(22) Filed: Sep. 10, 2013

(51) Int. Cl.
*A63B 53/14* (2006.01)
*A63B 47/02* (2006.01)

(52) U.S. Cl.
CPC ..... *A63B 47/02* (2013.01)
USPC ..... 473/286

(58) Field of Classification Search
CPC ..... A63B 47/02
USPC ..... 473/286
See application file for complete search history.

(56) References Cited

U.S. PATENT DOCUMENTS

| | | | | |
|---|---|---|---|---|
| 7,086,959 | B2 * | 8/2006 | D'Agguano | 473/282 |
| 7,384,347 | B2 * | 6/2008 | Milne | 473/286 |
| 2007/0259731 | A1 * | 11/2007 | Barouh | 473/282 |
| 2008/0096682 | A1 * | 4/2008 | Fox | 473/251 |

* cited by examiner

*Primary Examiner* — Benjamin Layno
(74) *Attorney, Agent, or Firm* — G. Brian Pingel; Camille L. Urban; David M. Breiner

(57) ABSTRACT

Disclosed is an attachment for a club. In example embodiments the attachment may be configured to fit at an end of the club, for example, a golf club. In example embodiments, the attachment may include a crown and a body. In example embodiments, the body may be configured to capture a golf ball or, in the alternative, a golf club or a flag stick. In example embodiments the body may include a first aperture and a second aperture wherein the first aperture and the second aperture are substantially aligned with one another and configured to accommodate at least one of the golf club and the flag stick.

20 Claims, 18 Drawing Sheets

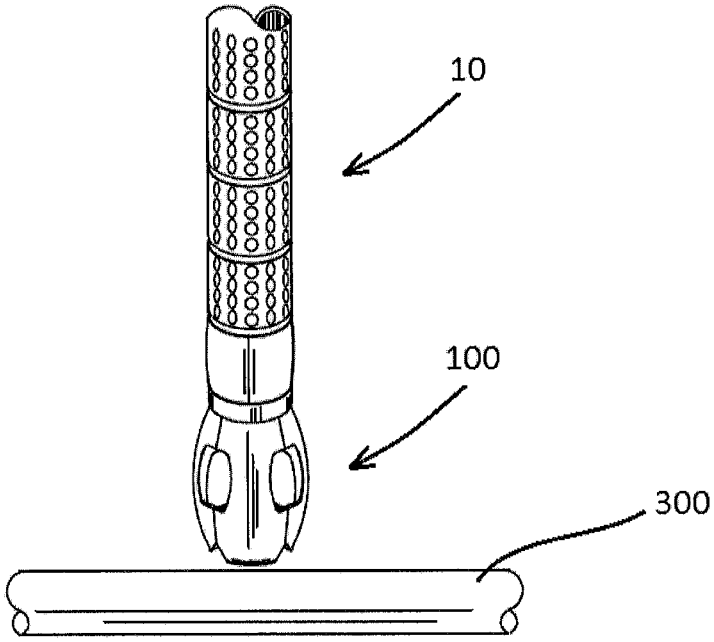
FIG. 6B
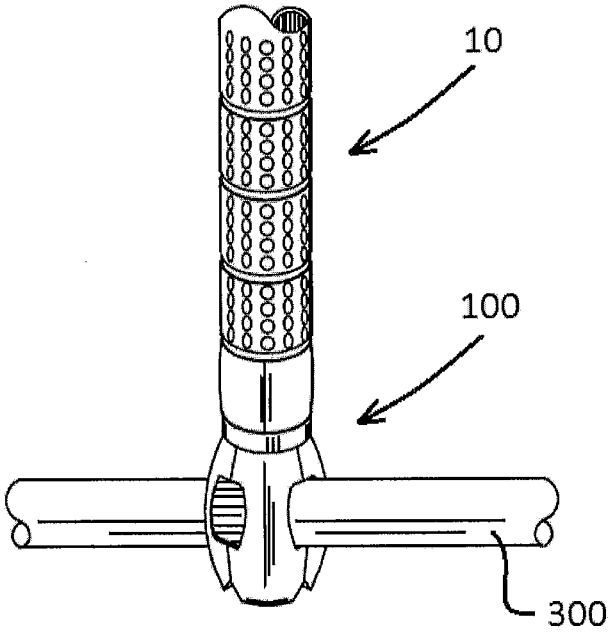

RETRIEVER

BACKGROUND

1. Field

Example embodiments relate to an attachment. In example embodiments the attachment may be configured to attach to a club, for example, a golf club such as, but not limited to, a golf putter. In example embodiments the attachment may be configured to capture a golf ball and at least one of a golf club and a flag stick and thus may act as a golf ball retriever, a golf club retriever, and a flag stick retriever.

2. Description of the Related Art

Golf is a sport in which a player uses clubs to knock a ball into a hole. During play, players may be required to bend over to pick up various items such as, but not limited to, flag sticks, golf balls, and golf clubs. Frequent bending over, however, may cause stress on a player's back. Thus, some inventors have sought to minimize this motion by modifying clubs to include retrievers configured to retrieve a golf ball.

FIG. 1A illustrates an example of a putter 10. As shown in FIG. 1A, the putter 10 includes shaft 3 with a putter head 5 arranged at an end thereof. Typically, the putter 10 includes a grip 7 which enables a player to firmly grasp the putter 10. FIG. 1B illustrates an example of an attachment 20 which fits at an end of the putter 10. As shown in FIG. 1B, the attachment 20 includes a substantially hollow base 22 with three flexible fingers 24 extending from the base 22. In this particular example, the base 22 fits over the grip 7 as shown in FIGS. 1C and 1D.

FIGS. 1E, 1F, and 1G illustrate attachment 20 being used to pick up a golf ball 30 lying on the ground G. As shown in FIG. 1E, the attachment 20 is placed over the ball 30 and then pushed towards the ball 30 until the fingers 24 capture the ball 30 as shown in FIG. 1F. Once captured, the club 10 may be pulled away from the ground G carrying the ball 30 with it as shown in FIG. 1G. This simple attachment 20 allows a golfer to use his club to pick up a golf ball 30 without having to bend over.

SUMMARY

The inventor notes that while several attachments for capturing a golf ball are available on the market, none are configured to capture other articles such as, but not limited to, a flag stick or a golf club. As such, the inventor has set out to design an attachment that may be configured to fit on an end of a golf club and may be configured to capture not only a golf ball, but in the alternative, a flag stick and a golf club as well. The invention, however, is not limited by the above application as the attachment may be configured to retrieve other articles which may be completely unrelated to golf.

Disclosed is an attachment forming the present invention. In example embodiments the attachment may be configured to fit at an end of a club, for example, a golf club such as, but not limited to, a putter. In example embodiments, the attachment may include a crown and a body. In example embodiments, the body may be configured to capture a golf ball and at least one of a golf club and a flag stick. In example embodiments the body may include a first aperture and a second aperture wherein the first aperture and the second aperture are substantially aligned with one another and configured to accommodate at least one of the golf club and the flag stick.

BRIEF DESCRIPTION OF THE DRAWINGS

Example embodiments are described in detail below with reference to the attached drawing figures, wherein:

FIGS. 6A-6B illustrate an operation of retrieving one of a flag stick and a golf club in accordance with example embodiments;

DETAILED DESCRIPTION

Figure 1A:
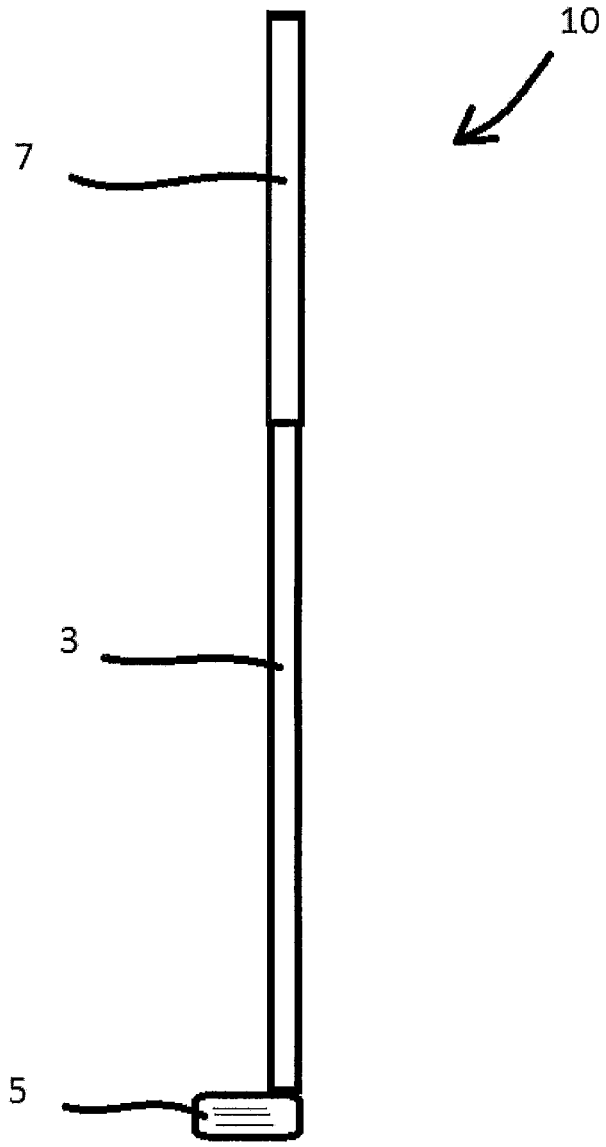
FIG. 1A Prior Art
FIG. 1A is a view of a golf putter in accordance with the prior art.
Figure 1B:
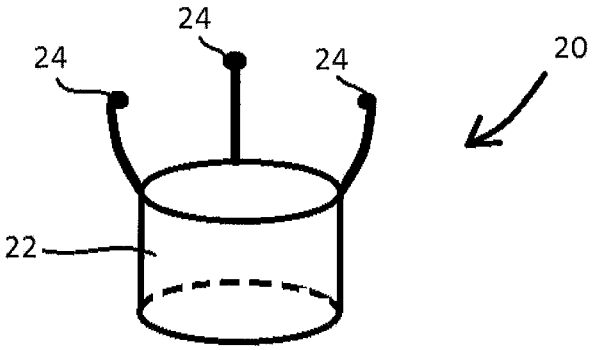
FIG. 1B Prior Art
FIG. 1B is a view of an attachment in accordance with the prior art.
Figure 1C:
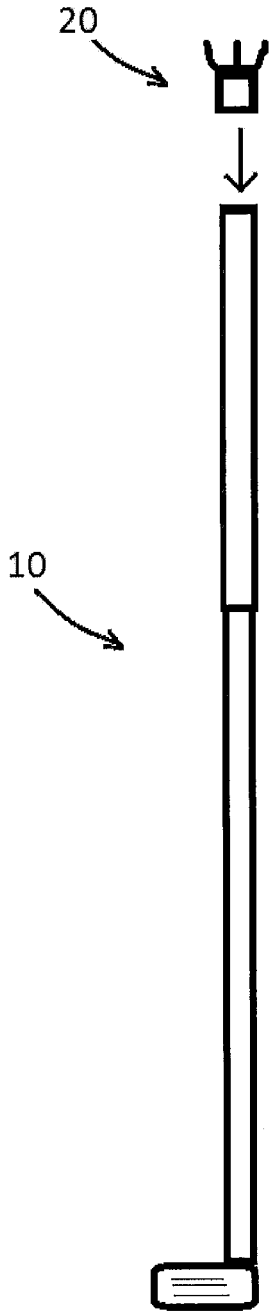
FIG. 1C Prior Art
FIGS. 1C and 1D are views showing the prior art attachment attaching to the prior art putter.
Figure 1D:
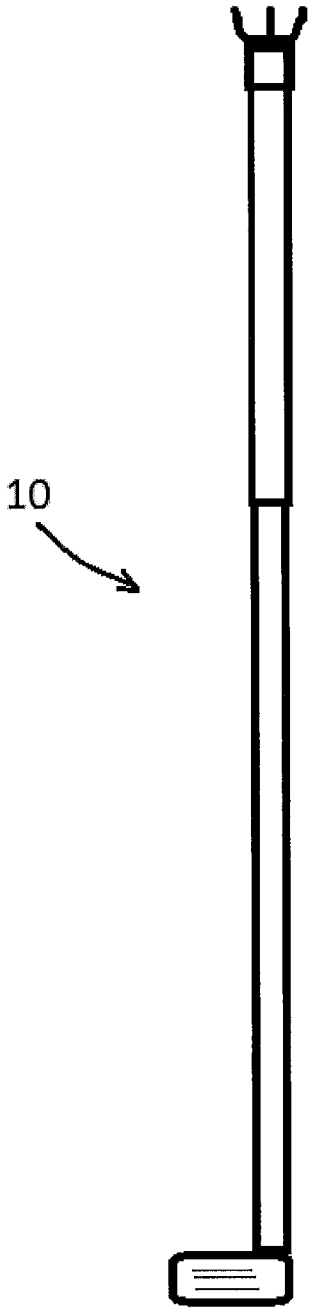
FIG. 1D Prior Art
Figure 1E:
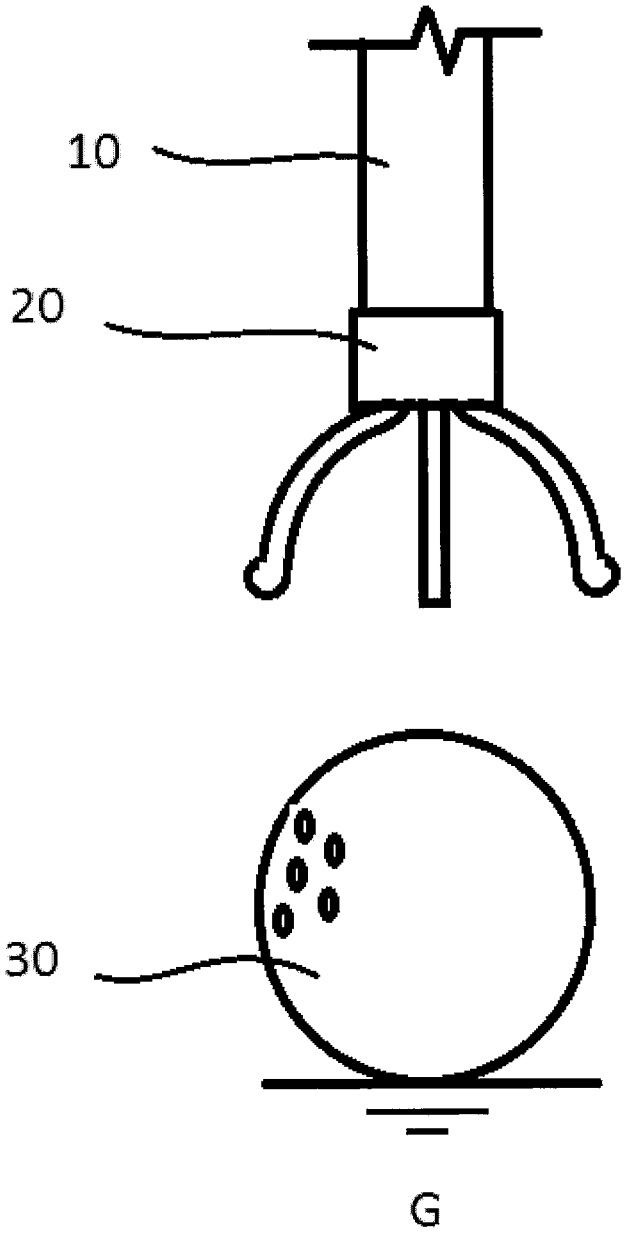
FIG. 1E Prior Art
FIGS. 1E-1G are views of the prior art golf club and the prior art attachment being used to pick up a golf ball.
Figure 1F:
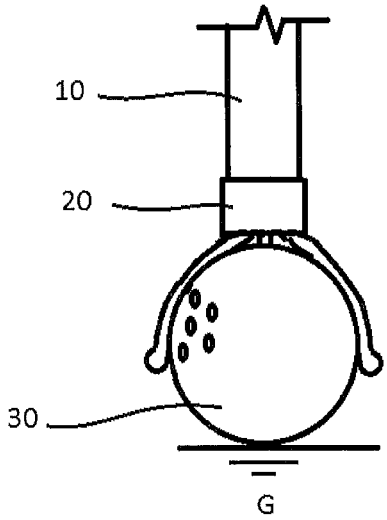
FIG. 1F Prior Art
Figure 1G:
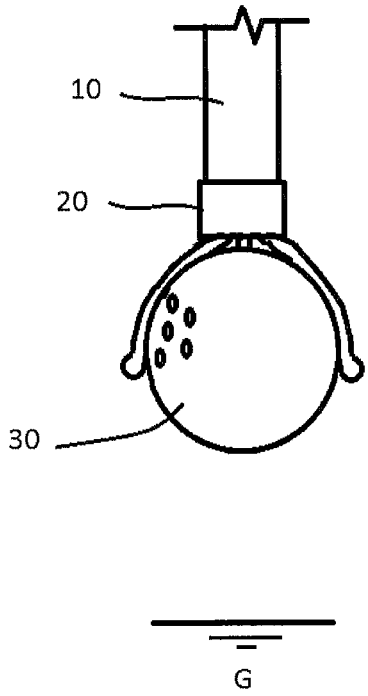
FIG. 1G Prior Art

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "connected to," or "coupled to" another element or layer, it can be directly on, connected to, or coupled to the other element or layer or intervening elements that may be present. In contrast, when an element is referred to as being "directly on," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to an attachment. In example embodiments the attachment may be configured to attach to a club, for example, a golf club such as, but not limited to, a golf putter. In example embodiments the attachment may be configured to capture at least one of a golf ball, a golf club, and a flag stick.

Figure 2A:
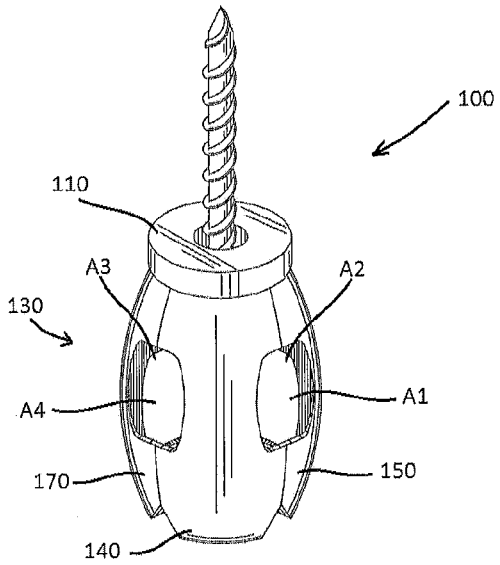
FIG. 2A is a perspective view of an attachment in accordance with example embodiments.
Figure 2B:
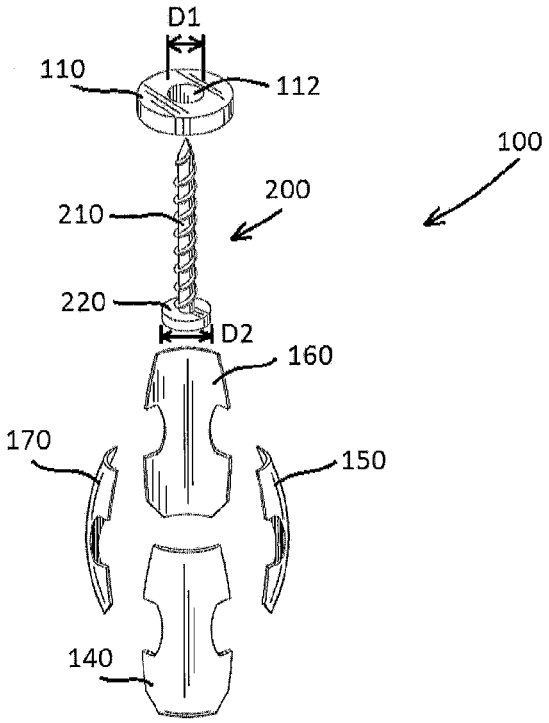
FIG. 2B is an exploded view of the attachment in accordance with example embodiments.

FIGS. 2A and 2B illustrate a perspective view and an exploded view of an attachment 100 in accordance with example embodiments. As shown in FIGS. 2A and 2B, the attachment 100 may include a crown 110 and a body 130 attached to the crown 110. In example embodiments, the body 130 may be configured to capture an article such as, but not limited to, a golf ball, a golf club, and a flag stick. In FIGS. 2A and 2B the body 130 is illustrated as being comprised of a plurality of prongs. In the nonlimiting example of FIGS. 2A and 2B, the plurality of prongs is comprised of four prongs: a first prong 140, a second prong 150, a third prong 160, and a fourth prong 170. Although the figures illustrate the body 130 as including four prongs, 140, 150, 160, and 170, this is not intended to be a limiting feature of example embodiments as the body 130 may include less than four prongs (for example, two prongs) or more than four prongs (for example, six prongs). Thus, the number of prongs associated with the body 130 is not intended to be a limiting feature of example embodiments.

In example embodiments, the plurality of prongs may be comprised of a resilient material. Thus, in example embodiments, the plurality of prongs may flex under an applied load. For example, in example embodiments, each of the first, second, third, and fourth prongs 140, 150, 160, and 170 may be comprised of a resilient material such as, but not limited to, rubber or plastic. This latter feature, however, is not intended to limit example embodiments, since the plurality of prongs may be made from another suitable material, for example, a metal or a composite material.

Figure 3A:
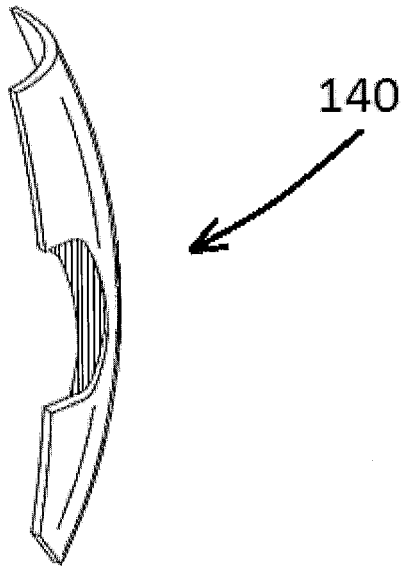
FIGS. 3A-3D are views of a prong in accordance with example embodiments.
Figure 3B:
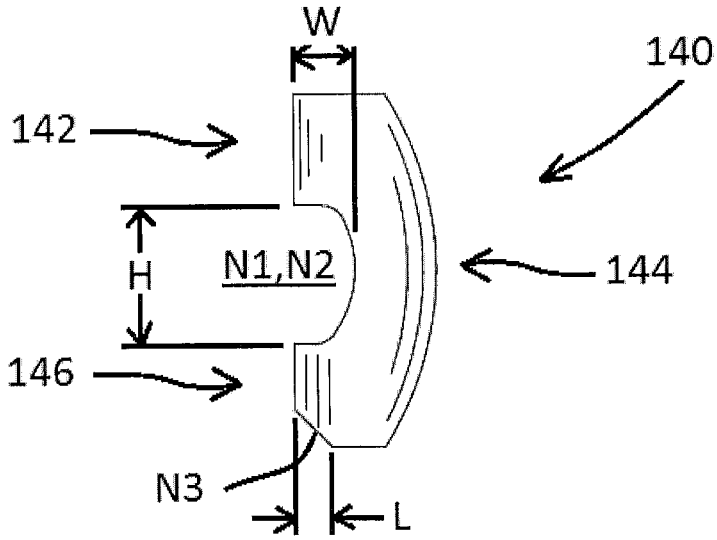
Figure 3C:
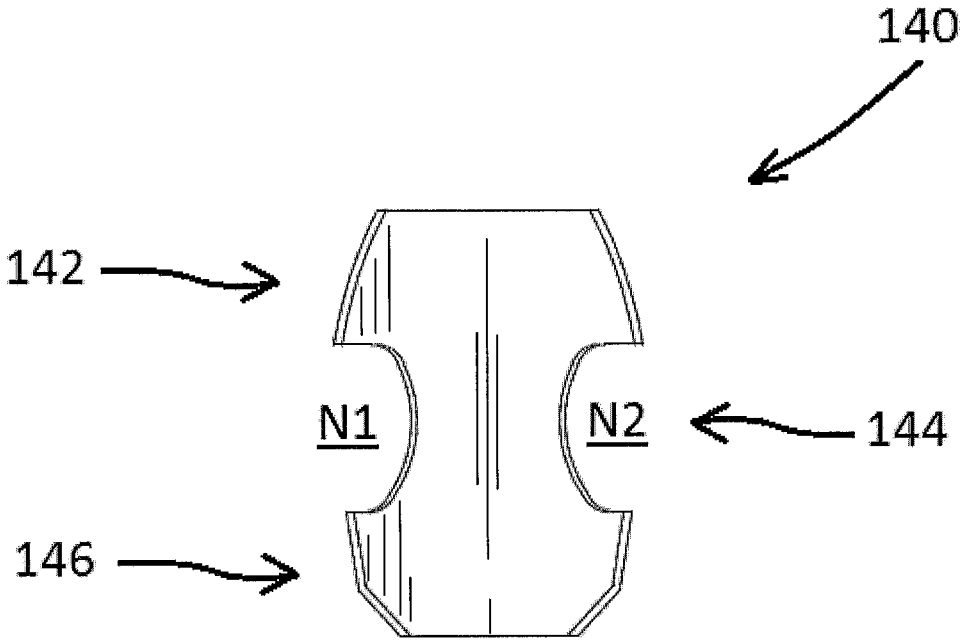
Figure 3D:
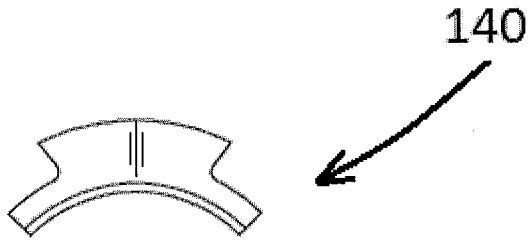

FIG. 3A is a perspective view of the first prong 140 in accordance with example embodiments. FIGS. 3B, 3C, and 3D represent a first side view of the first prong 140, a second side view of the first prong 140, and a top view of the first prong 140. In example embodiments, each of the second prong 150, the third prong 160, and the fourth prong 170 may be, but is not required to be, substantially identical to the first prong 140, thus, detailed descriptions thereof are omitted for the sake of brevity.

Referring to FIGS. 3A-3D, the first prong 140 may include an upper cup shaped portion 142 and a lower cup shaped portion 146. Between the upper cup shaped portion 142 and the lower cup shaped portion 146 is a neck 144 which may connect the upper cup shaped portion 142 to the lower cup shaped portion 146. In example, embodiments, the first prong 140 may have a first notch N1 and a second notch N2 on either side of the neck 144. Thus, in example embodiments, the neck 144 may have a width smaller than a width of the upper cup shaped portion 142 and the lower cup shaped portion 146. In example embodiments the first and second notches N1 and N2 may align with corresponding notches of an adjacent prong and may form a hole in the body 130 through which one of a golf club and a flag stick may pass. The inventor has found that a height H of the notches N1 and N2 and a width W of the notches of about 0.75 inches and about 0.375 inches to about 0.25", respectively, may work well for retrieving one of a golf club and/or a flag stick.

In example embodiments, the first prong 140 may further include a third notch N3. The third notch N3, for example, may be configured to allow the prong to deform or displace when the first prong 140 encounters an object, for example, a golf ball, a golf club, and/or a flag stick. For purposes of illustration only, the notch N3 may have a leg L that is about ¼" of an inch. Example embodiments, however are not limited thereto as the leg may have a length greater than or less than about ¼" of an inch.

Referring back to FIGS. 2A and 2B, the crown 110 may include a hole 112 through which a fastening member 200 may pass. Thus, in example embodiments, the crown 110 may resemble an annular disk. In example embodiments, the fastening member 200 may resemble a screw having a threaded portion 210 configured to pass through the hole 112 of the crown 110. In example embodiments the fastening member 200 may further include a head 220 which may prevent the fastening member 200 from completely passing through the crown 110. For example, the hole 112 of the crown may resemble a circular hole having a first diameter D1 and the head 220 may resemble a cylindrical disk having a second diameter D2. In example embodiments, because the second diameter D2 may be larger than the first diameter D1, the fastening member 200 may not pass completely through the hole 112 of the crown 110.

In example embodiments, the first, second, third, and fourth prongs 140, 150, 160, and 170 may be separately formed and then attached to the crown 110, for example, by gluing or welding, or the first, second, third, and fourth prongs 140, 150, 160, and 170 may be formed integrally with the crown 110, as through a machining or casting process.

Figure 4A:
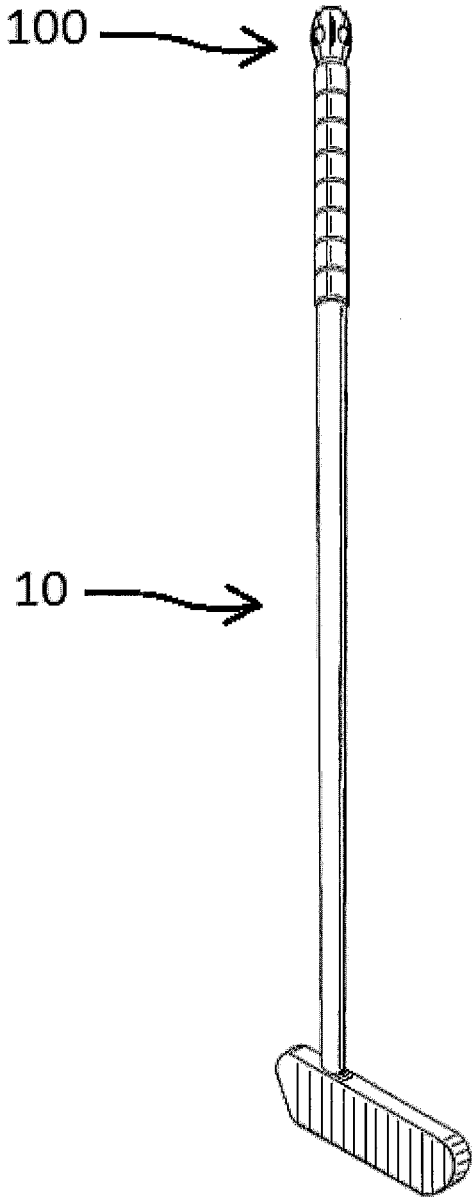
FIG. 4A is a view of a putter with an attachment in accordance with example embodiments.
Figure 4B:
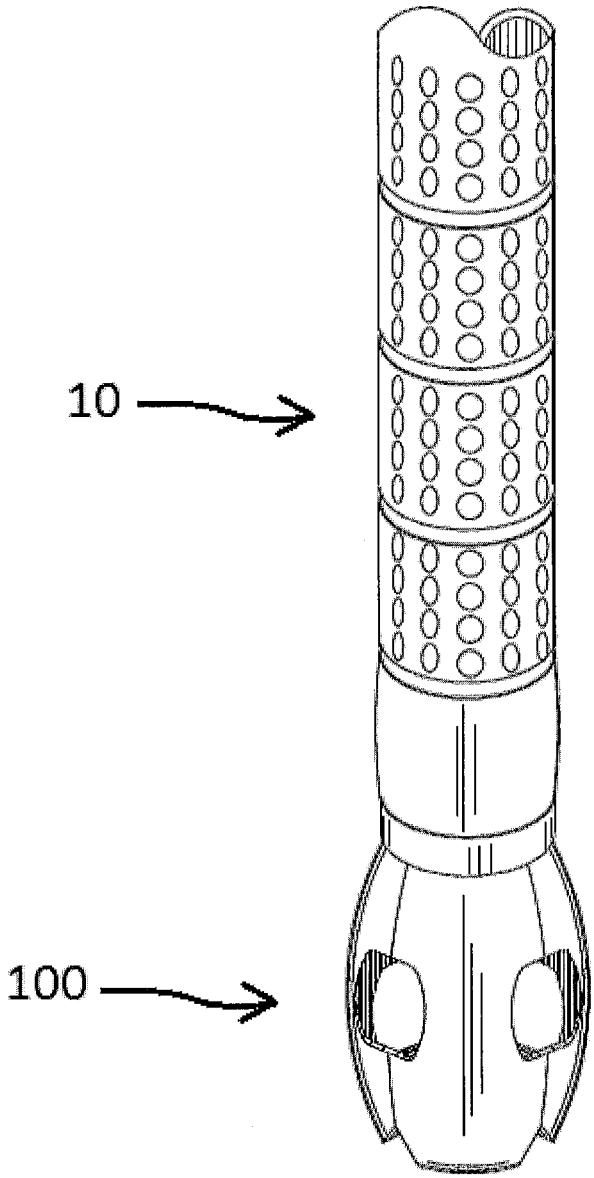
FIG. 4B is a close up view of the attachment attached to an end of the putter in accordance with example embodiments.

In example embodiments, the fastening member 200 may be used to attach the attachment 100 to an end of a conventional golf club, for example, an end of a conventional putter. For example, FIG. 4A illustrates the attachment 100 attached to an end of a conventional putter 10 and FIG. 4B illustrates a close up view of the attachment 100 attached to and end of the putter 10.

Figure 5A:
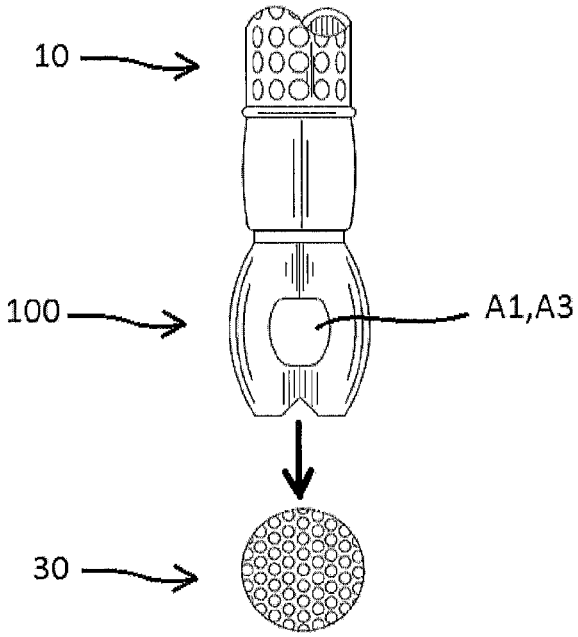
FIGS. 5A-5D illustrate an operation of retrieving a ball in accordance with example embodiments.
Figure 5B:
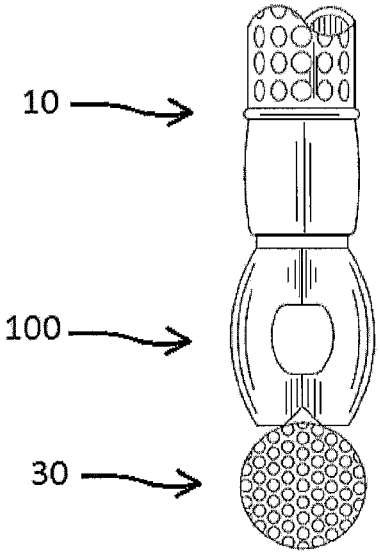

FIG. 5A illustrates the attachment 100 over a conventional golf ball 30. To retrieve the ball 30, a user may simply push the attachment 100 onto the ball 30 as shown in FIG. 5B. Because the prongs 140, 150, 160, and 170 are made of a resilient material, the prongs 140, 150, 160, and 170 deflect away from the ball 30 due to the ball 30 providing a reactive force against the notches of the prongs 140, 150, 160, and 170. As the attachment 100 is pushed further along the ball 30 an the prongs 140, 150, 160, and 170 move away from one another until an underside of the ball 30 becomes trapped by the prongs 140, 150, 160, and 170. At this point the ball 30 is captured by the attachment 100 and if the attachment 100 is pulled upwards, the ball 30 will travel with it.

FIG. 6A illustrates the attachment 100 over a conventional flag stick 300. To retrieve the flag stick 300, a user may simply push the attachment 100 onto the flagstick 300. Because the prongs 140, 150, 160, and 170 are made of a resilient material, the prongs 140, 150, 160, and 170 deflect away from the flag stick 300 due to the flag stick 300 providing a reactive force against the notches of the prongs 140, 150, 160, and 170. As the attachment 100 is pushed further along the flagstick 300 an underside of the flagstick becomes trapped by the lips 148 of the notches N1, N2 of the prongs 140, 150, 160, and 170. At this point the flagstick 300 is captured by the attachment 100 and if the attachment 100 is pulled upwards, the flag stick 300 will travel with it. A shaft of a golf club may be captured and retrieved by similar steps.

Referring back to FIG. 2A, it is observed that the attachment 100 may include the crown 110 and the body 130. In example embodiments, the body 130 may include a plurality of apertures formed by a plurality of notches that may be in the necks of the first, second, third, and fourth prongs 140, 150, 160, and 170. In FIG. 2A four apertures A1, A2, A3, and A4 are shown. In example embodiments the apertures may have a width wide enough to accommodate at least one of a golf club shaft and a flag stick. In example embodiments at least two apertures of the plurality of apertures must be aligned with one another so that at least one of the golf club shaft and the flag stick may be captured therein. For example, in example embodiments the aperture A1 formed by the notches N1 and N2 of the first and second prongs 140 and 150 must be substantially in line with the aperture A3 formed by the notches N1 and N2 of the third and fourth prongs 160 and 170 (see at least FIG. 5A). Similarly, the aperture A2 formed by the notches N1 and N2 of the second and third prongs 150 and 160 may be aligned with the fourth aperture A4 formed by the notches N1 and N2 of the fourth and first prongs 170 and 140. Thus, in example embodiments, the body 130 of the attachment 100 may include at least a first aperture and second aperture aligned with one another and configured to accommodate at least one of a golf club and a flag stick.

Figure 5C:
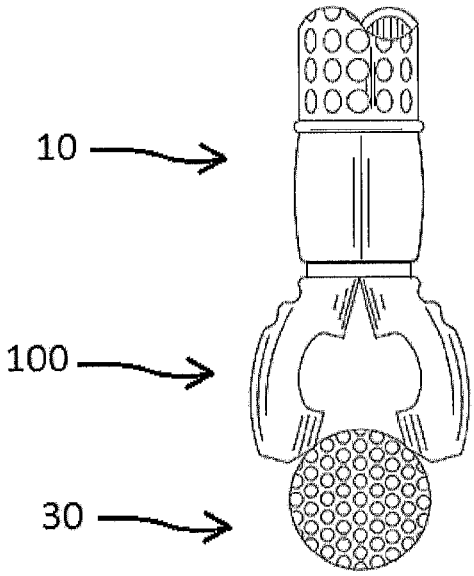
Figure 5D:
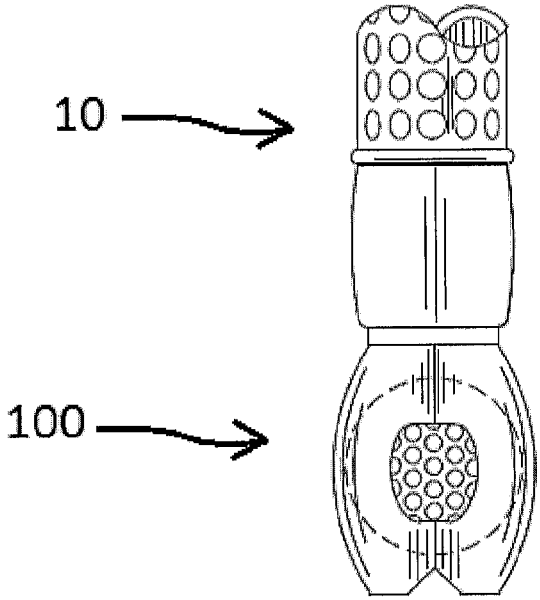

In example embodiments, each of the first, second, third, and fourth prongs 140, 150, 160, and 170 may flex away from one another during a capture operation. For example, as shown in FIGS. 5A-5C the first and second prongs 140 and 150 flex away from each other. In this application, the direction of flexure, however, does not have to be along a straight line, but may be, for example, in a case where the body includes only two prongs. Thus, in example embodiments, two adjacent prongs may flex directly away from each other (as along a straight line) or indirectly away from each other, for example when the body 130 includes four prongs.

Figure 7:
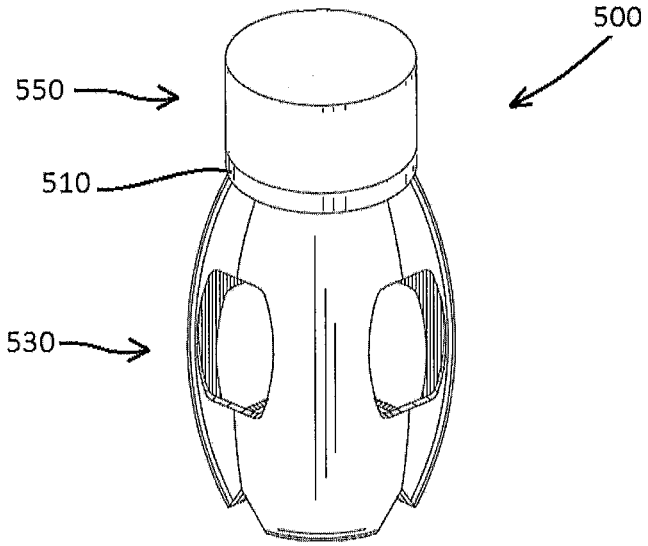
FIG. 7 illustrates an attachment in accordance with example embodiments.

Although FIGS. 2A-6B illustrate an example of an attachment that may function as a retriever, the invention is not intended to be limited by the specific embodiments. For example, FIG. 7 illustrates another example of an attachment 500. In FIG. 7, the attachment 500 may be substantially the same as the attachment 100. For example, in FIG. 7, the attachment 500 may include a body 530 which may be substantially identical to the body 130 and a crown 510 which may be substantially identical to the crown 110 except that the crown 510 may not have a hole similar to hole 112. Furthermore, in FIG. 7, the attachment 500 does not have a fastening device which includes a threaded body and a head. Rather, in example embodiments, the attachment 500 includes a sleeve 550 which may be configured to fit over an end of a golf club, for example, a putter, to secure the attachment 500 to the golf club. In example embodiments the sleeve 550 may be made of a resilient material which may allow for the attachment 500 to have a snug fit on an end of the golf club.

Figure 8:
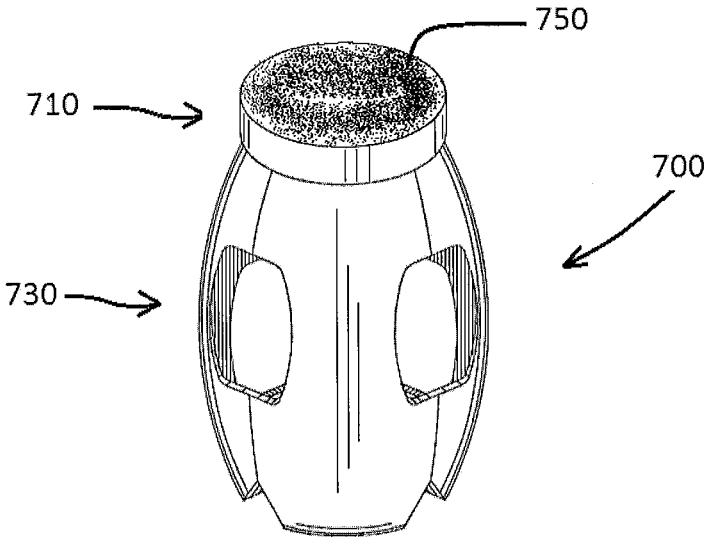
FIG. 8 illustrates an attachment in accordance with example embodiments.

FIG. 8 illustrates another example of an attachment 700. In example embodiments, the attachment 700 may be substantially the same as the attachments illustrated in FIGS. 2A-7 in that the attachment 700 may include a body 730 which may be substantially identical to the bodies 130 and 530. In example embodiments, however, the attachment 700 may be attached to a golf club, for example, a putter, using an adhesive 750 which may be a glue or a material such as, but not limited to, Velcro.

Figure 9:
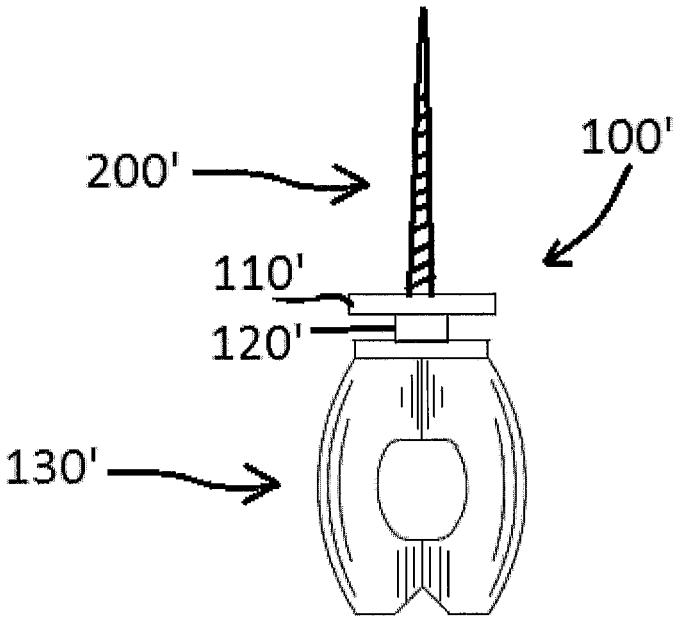
FIG. 9 illustrates an attachment in accordance with example embodiments.

FIG. 9 is a view of an attachment 100' in accordance with example embodiments, In FIG. 9, the attachment 100' may be substantially identical to the previously described attachment 100. For example, the attachment 100' may include a crown 110', a body 130', and a fastening member 200' which may be substantially identical to the crown 110, the body 130, and the fastening member 200, thus, a detailed discussion thereof is omitted for the sake of brevity. In example embodiments, the attachment 100' may further include a neck 120' between the crown 110' and the body 130'. In example embodiments, the neck 120' may resemble, for example, a circular disc or a short cylinder having a thickness of about, but not limited to, 0.125 inches, though example embodiments are not limited thereto. In example embodiments, the neck 120' may provide for additional flexibility which may not be present in the attachment 100.

Figure 10A:
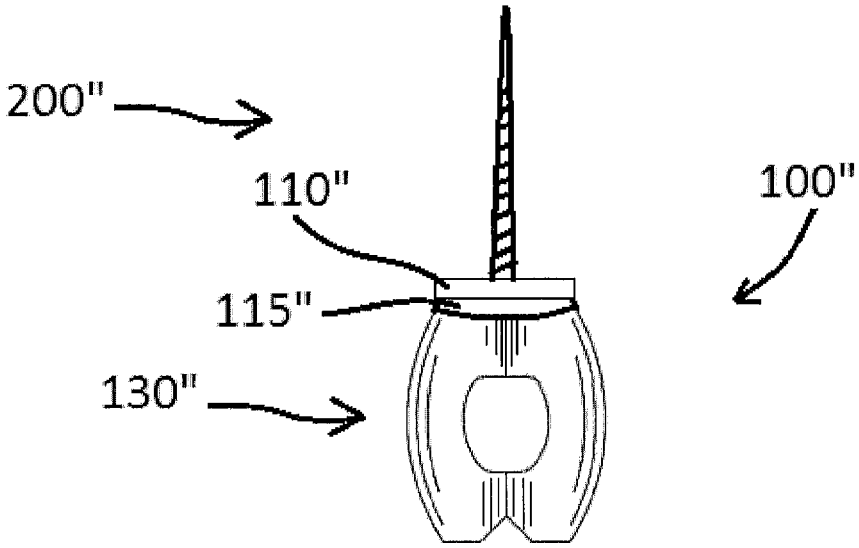
FIGS. 10A and 10B illustrate an attachment in accordance with example embodiments.
Figure 10B:
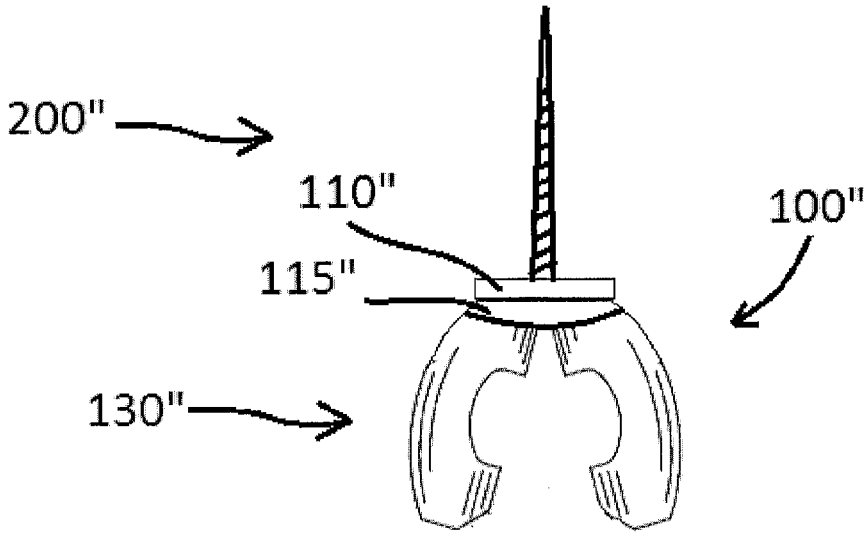

FIGS. 10A and 10B illustrate another example of an attachment 100" in accordance with example embodiments. In example embodiments, the attachment 100" may be substantially similar to the attachment 100. For example, the attachment 100" may include a fastening member 200", a crown 110", and a body 130" which are substantially similar to the fastening member 200, the crown, 110, and the body 130 of attachment 100. However, in example embodiments, the attachment 100" may include a biasing member 115" configured to bias the prongs of the body 130" in a closed position as shown in FIG. 10A. The biasing member 115" may be made of an elastic material, for example, rubber, which may allow the prongs of the body 130" to move away from each other, as shown in FIG. 10B, while the body 130" captures a golf ball, a flag stick, or a golf club, and then bias the prongs to their original position once the golf ball, flag stick, or golf club is captured. Due to the presence of the biasing member 115", the prongs of body 130" may be made of a relatively stiff material, for example, steel, plastic, or a stiff composite material and the prongs may be attached to the crown 110" by a pin-type connection (a connection which allows the prongs to rotate relative to the crown 110"). In example embodiments, the biasing member 115" may resemble, but is not required to resemble, a rubber band wrapped around an outside of the body 130". As another example, the biasing member 115" may resemble rubber strips placed on inside surfaces of the prongs to connect the prongs together and bias them to a closed position as illustrated in FIG. 10A.

Figure 11A:
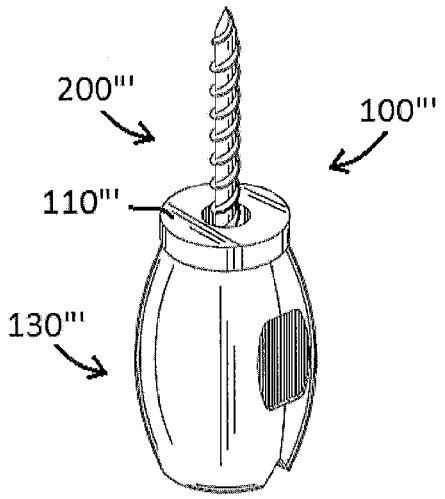
FIGS. 11A and 11B illustrate an attachment in accordance with example embodiments.
Figure 11B:
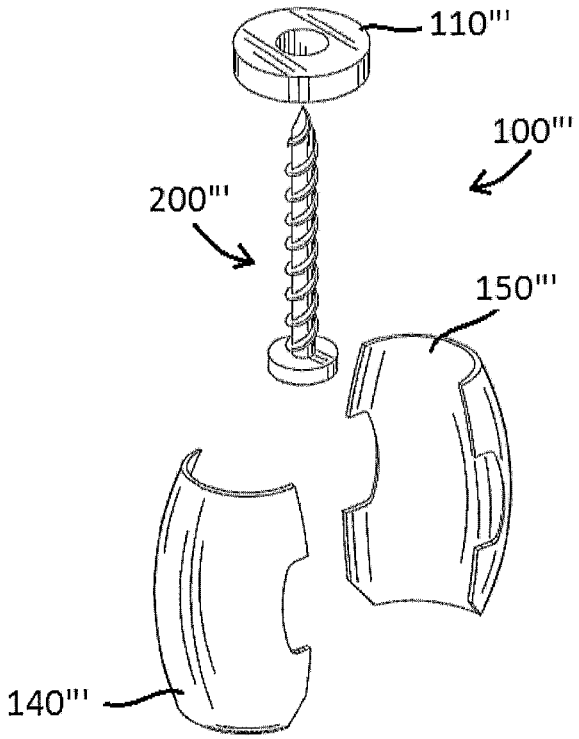

FIGS. 11A and 11B illustrate another example of an attachment 100''' in accordance with example embodiments. In example embodiments, the attachment 100''' may be substantially similar to the attachment 100. For example, the attachment 100''' may include a fastening member 200''', a crown 110''', and a body 130''' which are substantially similar to the fastening member 200, the crown 110, and the body 130 of attachment 100. However, in example embodiments, the body 130''' includes only two prongs 140''' and 150''' rather than four prongs 140, 150, 160, and 170. In the attachment 100''' the prongs may open apart to capture a golf ball and at least one of a flag stick and a golf club as described above. In example embodiments the body 130''' may have two apertures formed by notches in the first and second prongs 140''' and 150'''. Consistent with the previous example, the apertures of the body 130''' may be substantially aligned with one another so the body 130'' may capture one of a flag stick and a golf club.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

That we claim is:

1. An attachment comprised of:

a body configured to capture a golf ball and at least one of a golf club and a flag stick, wherein the body includes a first aperture and a second aperture, the first aperture and the second aperture being substantially aligned with one another and configured to accommodate the at least one of the golf club and the flag stick, the body includes a plurality of flexible prongs, and the plurality of prongs includes a first prong and a second prong, the first prong including a first notch and the second prong including a second notch, and the first notch and the second notch form the first aperture.

2. The attachment of claim 1, wherein the first prong includes a third notch and the second prong includes a fourth notch and the third and the fourth notches form the second aperture.

3. The attachment of claim 2, wherein the first prong is configured to flex away from the second prong.

4. The attachment of claim 1, wherein the plurality of prongs includes a third prong and a fourth prong and the third prong includes a third notch and the fourth prong includes a fourth notch and the third notch and the fourth notch form the second aperture.

5. The attachment of claim 4, wherein the second prong includes a fifth notch and the third prong includes a sixth notch and the fifth and sixth notches form a third aperture in the body and the first prong includes a seventh notch and the fourth prong includes an eighth notch and the seventh and eighth notches form a fourth aperture in the body and the third and fourth apertures are substantially in line with one another.

6. The attachment of claim 4, wherein the first prong includes a first inclined notch arranged at an end thereof and the second prong includes a second inclined notch arranged at an end thereof so that when the first prong and second prong are adjacent one another the first and second inclined notches form a first substantially V-shaped notch in the body.

7. The attachment of claim 6, wherein the third prong includes a third inclined notch arranged at an end thereof and the fourth prong includes a fourth inclined notch arranged at an end thereof so that when the third prong and fourth prong are adjacent one another the third and fourth inclined notches form a second substantially V-shaped notch in the body.

8. The attachment of claim 7, wherein the first prong includes a fifth inclined notch arranged at an end thereof and the fourth prong includes a sixth inclined notch arranged at an end thereof so that when the first prong and fourth prong are adjacent one another the fifth and sixth inclined notches form a third substantially V-shaped notch in the body.

9. The attachment of claim 8, wherein the second prong includes a seventh inclined notch arranged at an end thereof and the third prong includes an eighth inclined notch arranged at an end thereof so that when the second prong and the third prong are adjacent one another the seventh and eighth inclined notches form a fourth substantially V-shaped notch in the body.

10. The attachment of claim 9, further comprising:

a fastener configured to fasten the attachment to a club.

11. The attachment of claim 1, further comprising:

a fastener configured to fasten the attachment to a club.

12. The attachment of claim 11, wherein the fastener includes a threaded body.

13. The attachment of claim 11, wherein the fastener is an adhesive.

14. The attachment of claim 1, further comprising:

a biasing member connected to the body.

15. The attachment of claim 14, wherein the biasing member is arranged on an outside of the body.

16. The attachment of claim 14, wherein the biasing member is arranged on an inside of the body.

17. The attachment of claim 1, further comprising:

a crown; and a neck between the crown and the body.

18. A golf club comprising:

the attachment of claim 1.

19. The attachment of claim 1, wherein the first prong includes a first inclined notch arranged at an end thereof and the second prong includes a second inclined notch arranged at an end thereof so that when the first prong and second prong are adjacent one another the first and second inclined notches form a first substantially V-shaped notch in the body.

20. The attachment of claim 19, wherein the first prong includes a third inclined notch arranged at an end thereof and the second prong includes a fourth inclined notch arranged at an end thereof so that when the first prong and second prong are adjacent one another the third and fourth inclined notches form a second substantially V-shaped notch in the body.

* * * * *